United States Patent [19]

Valente et al.

[11] Patent Number: 4,955,174

[45] Date of Patent: Sep. 11, 1990

[54] EXPANDABLE BUILDING WITH MODULAR ROOF SYSTEM

[76] Inventors: Daniel J. Valente; Elizabeth M. Valente, both of 60 Sweet Rd., Glens Falls, N.Y. 12801

[21] Appl. No.: 464,856

[22] Filed: Jan. 17, 1990

[51] Int. Cl.[5] ..... E04G 21/00

[52] U.S. Cl. ..... 52/745; 52/79.1; 52/90

[58] Field of Search ..... 52/745, 747, 90, 92, 52/93, 79.1

[56] References Cited

U.S. PATENT DOCUMENTS

| | | | |
|---|---|---|---|
| 3,722,171 | 3/1973 | Godley | 52/745 |
| 4,003,182 | 1/1977 | Wokas | 52/745 |
| 4,467,585 | 8/1984 | Busby | 52/79.1 X |
| 4,567,709 | 2/1986 | Faw | 52/745 |
| 4,653,239 | 3/1987 | Randa | 52/92 X |
| 4,655,024 | 4/1987 | Grace et al. | 52/745 |
| 4,676,037 | 6/1987 | Nakasone | 52/745 X |
| 4,807,407 | 2/1989 | Horn | 52/79.1 |
| 4,850,174 | 7/1989 | Valente . | |

*Primary Examiner*—Philip C. Kannan
*Attorney, Agent, or Firm*—Nixon & Vanderhye

[57] ABSTRACT

An affordable single-family, detached house is constructed so that it is expandable from a one-story building to a two-story building. A one-story building wooden frame, including a plurality of side stud walls and a plurality of upper joists extending at the top of the side walls, is constructed. A roof, including pitched roof sections, is assembled and then lifted onto the top of the one-story frame. The roof is connected to the one-story frame so that the ceiling joists of the roof and upper joists of the one-story frame are adjacent each other. Connection is effected with readily releasable fasteners such as screws. When it is desired to build the second story, the releasable fasteners are disconnected, the roof is lifted off the one-story frame and placed on the ground adjacent to the house, and a second story frame is constructed on top of the first story frame. The second story frame includes a number of side stud walls with the upper joists of the first story frame at the bottom of the second story frame, and plywood is disposed on the upper joists to provide the subflooring for the second story. The roof is lifted onto the second story frame and connected, with nails or the like, to the second story frame.

13 Claims, 3 Drawing Sheets

FIG. 1
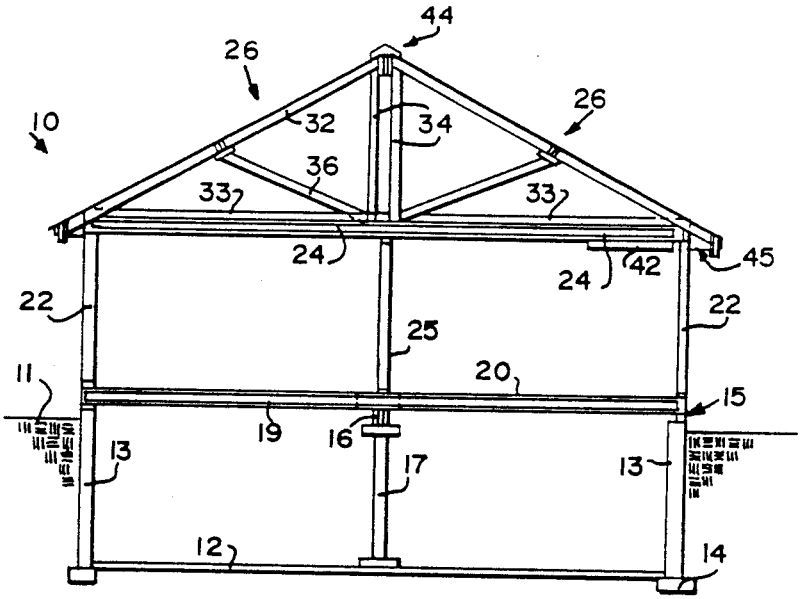
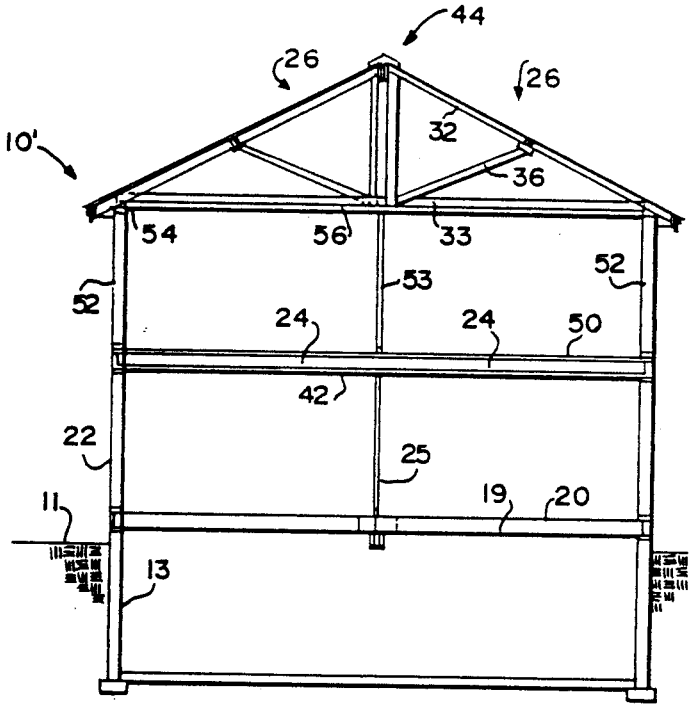
FIG. 2
FIG. 3
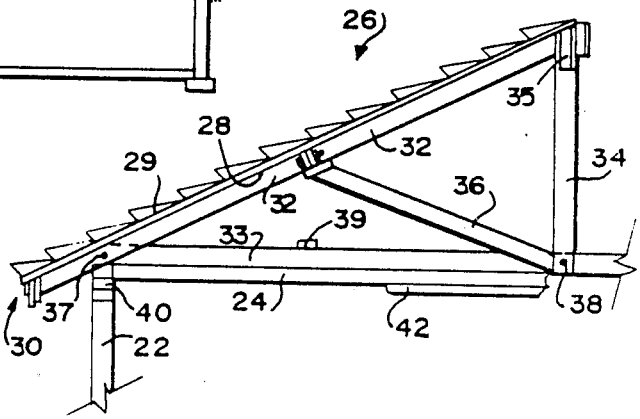

FIG. 4
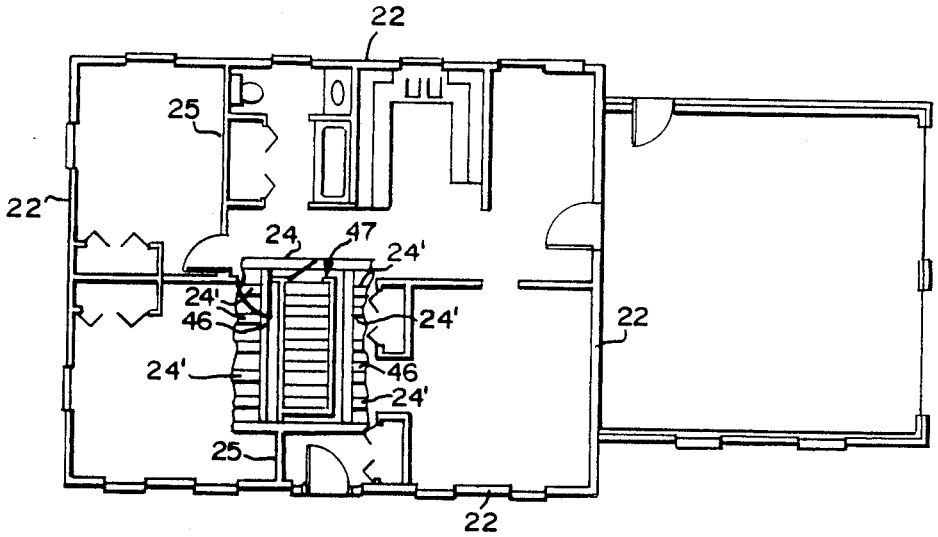
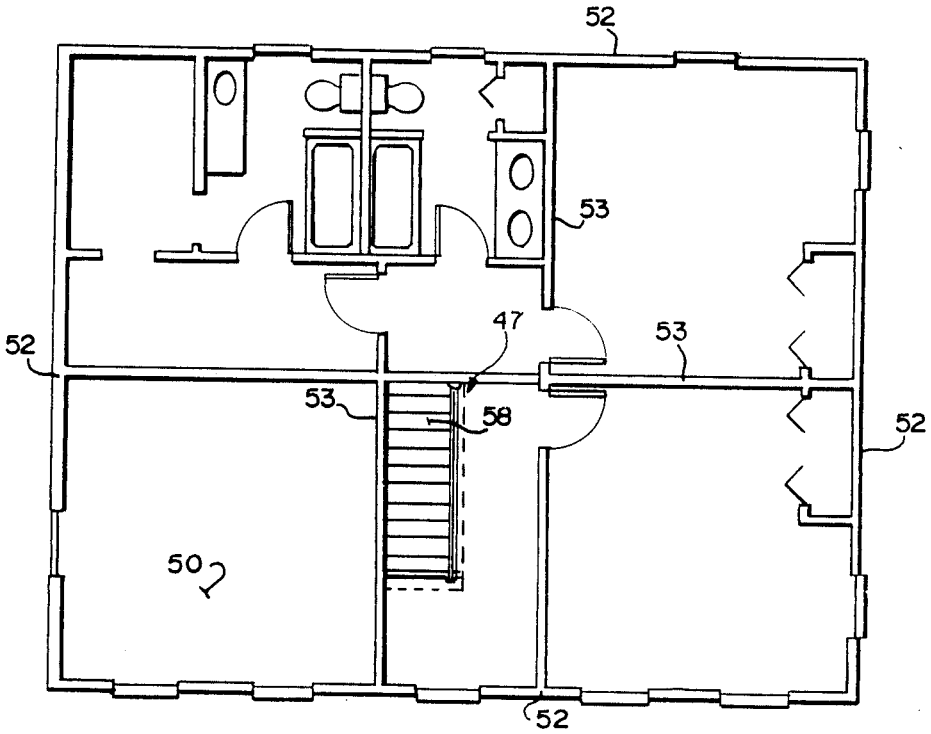
FIG. 5

EXPANDABLE BUILDING WITH MODULAR ROOF SYSTEM

BACKGROUND AND SUMMARY OF THE INVENTION

The lack of affordable housing is one of the major problems facing many areas of North America. When there is a lack of affordable housing, it is difficult to move forward with economic development since people can't work in a place where they can't afford to live. It is especially difficult for young couples to buy affordable, single-family dwellings, and those that can be purchased by young couples often become too small in a few years when the young couples have children.

According to the invention, the method of constructing a building, and a wooden frame house construction, are provided that can remedy the problem of the lack of affordable housing for single-family dwellings. According to the invention, it is possible to provide a pre-engineered house which sells for under $20,000 1990 U.S. dollars for a weather-tight shell, and has sufficient room, for a couple or a couple and a small child, to live comfortably (e.g., 1100 sq. ft.). When a larger home is necessary, the same house can be expanded, without horizontal additions, to double the living area size by the addition of a second story. Expansion is also done in an inexpensive manner, and the total cost of the expansion can be approximately the same as or less than the cost of the original weather-tight shell.

According to one aspect of the present invention, a method of constructing a one-story building that is expandable to include a second story is provided. The first step in the method is the construction of a one-story building frame including a plurality of side wall (such as stud walls), and a plurality of upper joists (such as 2"×10" joists) extending at the top of the side walls. Then a roof is constructed on the ground. The roof preferably is constructed as one or two modular roof sections such as illustrated in U.S. No. 4,850,174 (the disclosure of which is hereby incorporated by reference herein). A modular roof system includes pitched roofing sections (e.g., plywood or like fibrous material, subroofing, with asphalt shingles or like roofing thereon), and ceiling joists connected at the bottom of the pitched roofing sections. The ceiling joists are preferably 2"×6" ceiling joists. The roof (in either one or two sections) is lifted by a crane onto the top of the one-story building frame and the roof is connected to the one-story building frame so that the ceiling joists and the upper joists are adjacent to each other, using readily releasable fasteners such as screws.

When it is desirable to expand the house, the readily releasable fasteners are disconnected so that the roof can be removed from the house and the roof is lifted from the one-story frame and placed on the ground adjacent to it. Then a second story frame, including a plurality of side walls (such as stud walls) is constructed onto the first story frame with the upward joist of the first story frame at the bottom of the second story frame. Then the roof is lifted back onto the building and connected (e.g., with nails) to the second story frame. The upper joist of the first story preferable forms a stairwell opening therein (e.g., about 3'×9') so that after construction of the second story, a stairway may readily be provided between the second story and the first story without the necessity of disturbing the configuration of the upper joists.

The invention also comprises a wooden frame house having a first story wooden frame including a plurality of side stud walls, with upper joists (e.g., 2×10 joists) at the top of the stud wall. A roof comprising of one or two integral roof panel assemblies having wooden ceiling joists, and including fibrous subroofing with roofing applied thereon, is disposed on top of the first story wooden frame removable fastening means attached the roof to the first story wooden frame. The ceiling joists preferably define an opening therein adjacent the middle of the upper joists, large enough to accommodate a stairway therein if the house is expanded. The removable fastening means preferably comprise screws which may connect the ceiling joists to the upper joists utilizing angled brackets or the like.

It is the primary object of the present invention to provide an affordable, expandable detached single family dwelling. This and other objects of the invention will become clear from the inspection of the detailed description of the invention, and from the appended claims.

BRIEF DESCRIPTION OF THE DRAWINGS

FIG. 1 is a side cross sectional view showing a one-story expandable exemplary house according to the invention;

FIG. 2 is a view like that of FIG. 1 only showing the house expanded to include a second story;

FIG. 3 is a detailed view of a roof panel connected to the top of the first story frame of the FIG. 1 construction;

FIG. 4 is an exemplary first floor plan for the building of FIG. 1, showing the stairway-receiving opening formed in the upper joists;

FIG. 5 is a plan view of the second story of the house of FIG. 2; and

DETAILED DESCRIPTION OF THE DRAWINGS

Figure 6:
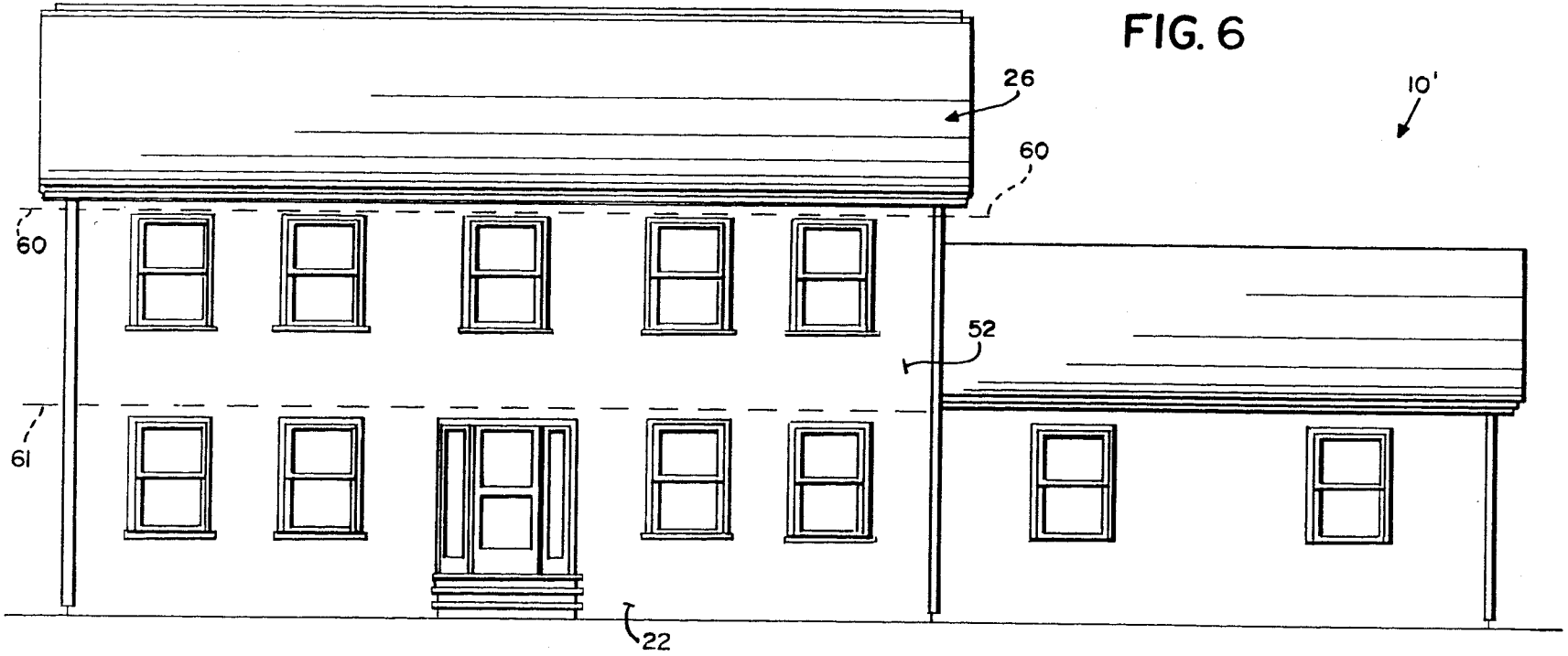
FIG. 6 is a front elevational view showing the house as expanded in full line, and showing the first story roof line in dotted line.

An exemplary one-story expandable house according to the invention is illustrated generally by reference number 10 in FIG. 1. Although the house can be constructed on a concrete slab, or the like, it is preferred that a basement be provided in the ground 11 surrounding the house 10. This may be accomplished by providing a four inch poured concrete slab 12 at the bottom, with a plurality of 8' poured concrete walls 13 extending upwardly therefrom, and supported on 20"×10" poured footings 14 with reinforcing rods. A 2"×6" mud sill 15 may also be provided and a plurality of 2"×10" girders 16 provide for the support for the upper portions of the house, along with steel pillars 17 and the like. As many girders and pillars 16, 17, or the like are provided as are necessary to provide adequate support for the upper portions of the house and to meet code requirements.

At the top of the poured concrete wall 13 and girders 16 a plurality of floor joists 19 are provided with subflooring 20 (such as $\mu$" tongue and groove plywood) supported thereby. The floor joists 19 preferably are about 2"×10" joists at 16" centers. Built atop of floor joist 19 are a plurality of side walls 22 (e.g., 2"×6" stud walls at 16" centers, with ½" plywood disposed on the outside thereof for receipt of aluminum sidings or the like). The side walls 22 (four being provided in FIG. 1 embodiment—see FIG. 4) have upper joists 24 disposed at the top thereof, the upper joist 24 preferably being about 2"×10" wooden joist on 16" centers.

The detached single family house 10 includes as an important part thereof a modular roof system including two roof assemblies 26 to form the pitched roof. The roof assemblies 26, in the manner of manufacture and assembly and construction thereof, are preferably as disclosed in U.S. Pat. No. 4,850,174, the disclosure which is hereby incorporated by reference herein. An exemplary individual roof assembly 26 is illustrated in FIG. 1 and in more detail in FIG. 3.

Each roof assembly 26 includes subroofing 28, such as ½" plywood or like fibrous material, with roofing 29, such as asphalt shingles and felt paper, applied thereon with facia, flashing, and the like 30. First joists 32, which may be 2"×6" wooden rafters, are connected to the bottom of subroofing 28, while ceiling joists 33, such as 2"×6" wooden joists, provide the bottom of a triangular shaped component, with 2"×6" upward supports 34 connected between the rafters 32 and the ceiling joists 33. Plywood splices 35 may be provided to facilitate ready interconnection of the upright supports 34 and the rafters 32, and braces 36 may be provided to brace the rafters 32. One inch wooden dowels 37, 38 connect the ceiling joist 33 to the rafters 32, and uprights 34 to the ceiling joists 33, respectively, and all of the components are nailed or otherwise affixed together. Two by four inch braces 39 also are provided interconnecting the ceiling joists 33.

The roof assemblies 26 are mounted on top of the stud walls and upper joists 34, with two 2"×6" top metal plates 40 or the like being provided between the stud wall 22 and the upper joist 24. The upper joists 24 support the interior ceiling structure 42, such as acoustical tile, plaster board, or the like. A ridge vent 44 is provided between the two roofing sections 26, and a continuous suffix vent 45 is also provided.

In order to facilitate the removal of the roofing assemblies 26 to expand the house 10, they are connected to the stud wall 22, upper joist 24, or like structures using releasable fastening means, preferably screws. Also, it is desirable to utilize the brackets illustrated in FIG. 11 in U.S. Pat. No. 4,850,174 to interconnect the components together.

Interior partitions are preferably provided as indicated at 25 in FIG. 1, such as by using 2"×4" wooden studs at 16" centers.

A further feature of the house 10 that allows it to be readily expanded to include a second story comprises a particular construction of the upper joists 24 so as to provide an opening for a stairway from the first story to an expanded second story, once constructed. Such an opening, and the components defining the opening, are illustrated in FIG. 4. Note, the upper joists 24 with—at a central portion of the house 10—include joist 24' which are not continuous across the upper part of the house, but rather are affixed to cross pieces (such as two inch by ten inch pieces) 46. The cross pieces 46 and the joists 24 to which they are connected define an opening 47. The opening 47 is large enough to receive a stairway therein. For example, as schematically illustrated in FIGS. 4 and 5, the opening 47 may be about three feet by nine feet six inches.

In the construction of house 10 after the side walls 22, upper joist 24, and the like have been constructed, either individually or together the roof panels 26 are lifted by a crane onto the top of the frame defined by the walls 22, joist 24, etc. The roof panel assemblies are attached to the frame with the ceiling joists 33 adjacent (preferably on top or slightly spaced from) the upper joists 24, utilizing removable fasteners such as screws. When it is desired to expand the house to include a second story, the screws are disconnected, and the roof assemblies 26 lifted by the crane off of the frame and placed on the ground 11 adjacent to the house. Then the second story frame is constructed. Plywood subflooring or the like 50 is placed on top of the upper joists 24 from the first story, and two×six inch side stud walls 52 are constructed on top of the joist 24, as well as two×four inch stud partition walls 53. Two two inch by six inch top plates 54 also may be provided at the top of the side stud walls 52, and after construction of the side walls 52, etc., the roof sections 26 are lifted back onto the top of the house and attached to the side walls or the like, either permanently (using nails) or removably (using screws). The ceiling joists 33 provide for support of the ceiling 56 of the second story of the building 10', the ceiling 56 being drywall, acoustical tile, etc., like the first floor ceiling 52.

FIG. 5 shows the second story plan for the house 10' and shows a stairway 58 positioned in the aperture 47, providing access between the first and second stories.

FIG. 6 shows an elevational view of a house 10' which has been expanded from a one-story house to a two-story house, according to the invention. Aluminum siding is shown provided on the first story side walls 22 and second story side walls 52, and the top of the first story roof line is shown by dotted lines 60, while the bottom of the first story roof line—before expansion—is illustrated by dotted line 61.

It will thus be seen that according to the present invention a method of affordably constructing an upwardly expandable building is provided. The first floor weather-tight shell can be marketed for $20,000 1990 U.S. dollars, and the second story may be added affordably, and with the proper crew may be constructed in as little as one day, or two days.

While the invention has been herein shown and described and what is presently conceived to be the most practical and preferred embodiment thereof, it will be apparent that many modifications may be made thereof within the scope of the invention, which scope is to be accorded the broadest interpretation of the appended claims so as to encompass all equivalent methods and devices.

What is claimed is:

1. A method of constructing a one-story building that is expandable to include a second story, comprising the steps of:

(a) constructing a one-story building frame including a plurality of side walls, and a plurality of upper joists extending at the tops of the side walls;

(b) constructing a roof, including pitched roofing sections, and ceiling joists connected at the bottom of the pitched roofing sections;

(c) lifting the constructed roof onto the top of the one-story building frame after construction thereof; and (d) connecting the roof to the one-story building frame, so that the ceiling joists and upper joists are adjacent each other, with readily releasable fasteners.

2. A method as recited in claim 1, wherein step (d) is practiced by screwing the roof to the one-story building frame.

3. A method as recited in claim 2, wherein step (d) is further practiced utilizing brackets having transverse faces which are screwed to the roof and the first story frame, respectively.

4. A method as recited in claim 1 further comprising expanding the building to include a second story, comprising the steps of:

(e) disconnecting the readily releasable fasteners so that the roof can be readily removed from the house;

(f) lifting the assembled roof from the one-story frame, and placing it on the ground adjacent thereto;

(g) constructing a second story frame including a plurality of side walls, onto the first story frame with the upper joists of the first story frame at the bottom of the second story frame; and (h) lifting the assembled roof back onto the top of the second story frame; and (i) connecting the roof to the second story frame.

5. A method as recited in claim 4, wherein the roof is provided by two triangular shaped roof assemblies, each including first joists connected to said roofing, said ceiling joists, and a plurality of upright supports, each upright connected at opposite ends thereof to said first joists and said ceiling joists, and said first joists and said ceiling joists connected together opposite said upright supports; and wherein steps (c), (f), and (h) are practiced by acting upon one of the two roof assemblies at a time.

6. A method as recited in claim 4, wherein step (a) is practiced to provide an aperture in the upper joists sufficiently large for the passage of a stairway therethrough; and comprising the further step of passing a stairway between the first story and the second story of the building through the aperture.

7. A method as recited in claim 4, wherein step (d) is practiced by screwing the roof to the one-story building frame.

8. A method as recited in claim 7, wherein step (i) is practiced by connecting the roof to the second story frame utilizing permanent fasteners.

9. A method as recited in claim 8, wherein step (i) is practiced by nailing the roof to the second story frame.

10. A method as recited in claim 4, wherein step (a) is practiced by constructing the upper joists of 2 inch by 10 inch wooden joists; and comprising the further step of applying the first story ceiling to the bottom of the upper joists.

11. A method as recited in claim 10, wherein step (g) is practiced by providing plywood flooring over the first story upper joists to form the floor for the second story.

12. A method as recited in claim 10, wherein step (a) is practiced to provide an aperture in the upper joists sufficiently large for the passage of a stairway therethrough; and comprising the further step of passing a stairway between the first story and the second story of the building through the aperture.

13. A method as recited in claim 4, wherein step (a) is practiced by constructing the upper joists of 2 inch by 10 inch wooden joists; and comprising the further step of applying the first story ceiling to the bottom of the upper joist.

* * * * *